US009576329B2

(12) United States Patent
Frankel et al.

(10) Patent No.: US 9,576,329 B2
(45) Date of Patent: Feb. 21, 2017

(54) SYSTEMS AND METHODS FOR EQUIPMENT INSTALLATION, CONFIGURATION, MAINTENANCE, AND PERSONNEL TRAINING

(71) Applicants: Michael Y. Frankel, Baltimore, MD (US); Joseph Berthold, Fallston, MD (US)

(72) Inventors: Michael Y. Frankel, Baltimore, MD (US); Joseph Berthold, Fallston, MD (US)

(73) Assignee: Ciena Corporation, Hanover, MD (US)

( * ) Notice: Subject to any disclaimer, the term of this patent is extended or adjusted under 35 U.S.C. 154(b) by 107 days.

(21) Appl. No.: 14/448,309

(22) Filed: Jul. 31, 2014

(65) Prior Publication Data

US 2016/0034761 A1 Feb. 4, 2016

(51) Int. Cl.

| | |
|---|---|
| ***G09G 5/22*** | (2006.01) |
| ***G06Q 50/20*** | (2012.01) |
| ***G09G 5/00*** | (2006.01) |

(52) U.S. Cl.

CPC ..... *G06Q 50/2057* (2013.01); *G09G 5/003* (2013.01); *G09G 2370/022* (2013.01); *G09G 2370/16* (2013.01); *G09G 2380/00* (2013.01)

(58) Field of Classification Search

CPC ..... G06K 9/00671
USPC ..... 345/633
See application file for complete search history.

(56) References Cited

U.S. PATENT DOCUMENTS 6,094,625 A * 7/2000 Ralston ..... G06F 3/011 239/161
6,115,656 A * 9/2000 Sudolsky ..... B64F 5/0045 701/3
6,549,940 B1 * 4/2003 Allen ..... G06F 17/30554 707/999.003
6,612,495 B2 * 9/2003 Reddersen ..... G06F 1/18 235/462.13
6,826,532 B1 * 11/2004 Casby ..... B60S 5/00 704/270
7,230,582 B1 6/2007 Dove et al.
7,339,730 B2 3/2008 Brodsky et al.
8,046,719 B2 * 10/2011 Skourup ..... G06F 3/011 715/757
8,749,889 B2 6/2014 Potakowskyj et al.
8,758,021 B2 * 6/2014 Takahashi ..... A61B 19/00 348/108

(Continued)

OTHER PUBLICATIONS

"Google Glass Comes to Manufacturing," Automation World, http://www.automationworld.com/control/google-glass-comes-manufacturing.

*Primary Examiner* — Javid A Amini

(74) *Attorney, Agent, or Firm* — Clements Bernard Walker PLLC; Christopher L. Bernard; Lawrence A. Baratta, Jr.

(57) ABSTRACT

A method, performed by a server, for supporting equipment service at a site includes receiving, from Head Mounted Equipment (HME) associated with an installer at a site, data relating to an inventory and location of equipment at the site, wherein the data is collected by the HME during equipment service, wherein the equipment includes one or more of a circuit pack, a line module, a cable and power equipment; and checking the equipment service based on the received data and at least one of plans associated with the site and configuration rules of the equipment.

18 Claims, 6 Drawing Sheets

(56) References Cited

U.S. PATENT DOCUMENTS 8,773,330 B2 * 7/2014 Edwards ..... G06F 3/011 345/7
8,893,164 B1 * 11/2014 Teller ..... G06Q 30/0252 725/12
8,922,590 B1 * 12/2014 Luckett, Jr. ..... G09G 5/377 345/633
8,935,646 B2 * 1/2015 Whitford ..... G06F 17/5004 716/119
9,153,074 B2 * 10/2015 Zhou ..... G06F 1/163
2002/0191002 A1 * 12/2002 Friedrich ..... G05B 19/409 345/632
2005/0206583 A1 * 9/2005 Lemelson ..... A61B 1/00048 345/7
2006/0012884 A1 * 1/2006 Snorteland ..... B60R 11/02 359/630
2008/0030429 A1 * 2/2008 Hailpern ..... A63F 13/10 345/8
2009/0083522 A1 * 3/2009 Boggs ..... G05B 19/056 712/220
2010/0005320 A1 * 1/2010 Squillante ..... H04L 12/10 713/300
2010/0053069 A1 3/2010 Tricoukes et al.
2011/0035324 A1 2/2011 Nielsen et al.
2011/0300809 A1 * 12/2011 Gordiyenko ..... H04B 17/23 455/67.12
2013/0044130 A1 * 2/2013 Geisner ..... G09G 5/00 345/633
2013/0088414 A1 4/2013 Artsyuhovich et al.
2013/0204097 A1 * 8/2013 Rondoni ..... A61B 5/04001 600/301
2013/0278631 A1 * 10/2013 Border ..... G02B 27/017 345/633
2014/0363059 A1 * 12/2014 Hurewitz ..... G06Q 30/0201 382/118
2015/0039878 A1 * 2/2015 Barten ..... G06K 7/0004 713/2
2015/0146007 A1 * 5/2015 Dusik ..... G06K 9/00671 348/161
2015/0185825 A1 * 7/2015 Mullins ..... G06T 19/006 345/633
2015/0302625 A1 * 10/2015 Greco ..... G06F 3/011 345/633
2016/0012465 A1 * 1/2016 Sharp ..... G06Q 20/18 705/14.17

* cited by examiner

SYSTEMS AND METHODS FOR EQUIPMENT INSTALLATION, CONFIGURATION, MAINTENANCE, AND PERSONNEL TRAINING

FIELD OF THE DISCLOSURE

The present disclosure relates generally to interactive monitoring/display systems and methods. More particularly, the present disclosure relates to a systems and methods for equipment installation, configuration, maintenance, and personnel training.

BACKGROUND OF THE DISCLOSURE

Equipment installation, configuration, maintenance and personnel training are complicated tasks. This is especially true in the high-tech fields (telecommunications, networking, high-performance computing, etc.) where multi-slot shelves or chassis can accept a wide variety of plug-in cards, modules, etc., where slots are difficult to differentiate visually, and where technology development cycles are so rapid that the personnel training is frequently unable to keep up. Communication equipment requirements further complicate the situation by demanding manual front-panel interconnection of plug-in cards, modules, with optical and/or electrical cabling. Conventional equipment installation procedures are focused on installer training, written manuals, and some built-in diagnostics in the equipment to identify circuit pack compatibility and provide some information on cable interconnections. Conventional equipment manual installation and training processes are cumbersome, expensive, error prone, unsecure, and not traceable.

BRIEF SUMMARY OF THE DISCLOSURE

In an exemplary embodiment, a method, performed by a server, for supporting equipment service at a site includes receiving, from Head Mounted Equipment (HME) associated with an installer at a site, data relating to an inventory and location of equipment at the site, wherein the data is collected by the HME during equipment service, wherein the equipment comprises one or more of a circuit pack, a line module, a cable and power equipment; and checking the equipment service based on the received data and at least one of plans associated with the site and configuration rules of the equipment. The method can further include providing information related to performing the equipment service to the HME, during the equipment service, wherein the HME is configured to display visual cues related to the equipment, in a field of view of the installer. The visual cues can show the installer which slots the equipment can be installed in and, once installed, the HME is configured to detect if the equipment was properly installed based on image processing, based on operational state of the equipment based on LED indicators, and/or communicating with equipment software.

The HME can be configured to detect the equipment through a camera, wherein the camera can be configured to perform one of recognizing one or more identifiers on the equipment and automatic image detection and processing algorithms to visually identify the equipment. The one or more identifiers can include at least one of a Bar Code, Quick Response (QR) Code, and a serial number. The HME can be configured to recognize the equipment through wireless communication between the HME and the equipment, wherein the wireless communication can utilize any one or more of Bluetooth, Bluetooth Low Energy (BLE), and Radio Frequency Identification (RFID) technologies. The location of the equipment can be based on determining the site using location services associated with the HME and on determining a particular location at the site based on correlation of visual identification of identifiers on the equipment.

The information related to the equipment service can be responsive to engineering associated with the site. The HME can be configured to detect an identifier at each end of a cable and to store information of an installation location of the cable based on the detected identifiers. The method can further include receiving from the HME, a detailed record of installation indicating information relating to at least one of deployed equipment, installed circuit packs, cable connectivity, LED indicator operational status, and information gathered from the equipment. The HME can communicate to the server through a mobile device. The method can further include providing manuals related to the equipment to the HME. The equipment service can be a service relating to at least one of installation, configuration and maintenance of the equipment.

Head Mounted Equipment (HME) for supporting equipment service at a site includes a communication interface; a camera; a processor communicatively coupled to the communication interface and the camera; and memory storing computer-executed instructions that, when executed, cause the processor to: capture data relating to an inventory and location of equipment at the site, wherein the data is collected by the HME during the equipment service, and wherein the equipment includes one or more circuit packs, line modules, cables, and power equipment, and check the equipment service based on the captured data based on at least one of plans associated with the site and configuration rules of the equipment. The memory storing computer-executed instructions that, when executed, can further cause the processor to receive, via the communication interface, information related to performing the equipment service at the site, and cause display of visual cues related to the equipment, in a field of view of the installer.

The memory storing computer-executed instructions that, when executed, can further cause the processor to: detect the equipment through the camera using one or more of recognizing one or more identifiers on the equipment and automatic image detection and processing algorithms to visually identify the equipment. The memory storing computer-executed instructions that, when executed, can further cause the processor to: recognize the equipment through wireless communication with the equipment, wherein the wireless communication utilizes any one or more of Bluetooth, Bluetooth Low Energy (BLE), and Radio Frequency Identification (RFID) technologies. The memory storing computer-executed instructions that, when executed, can further cause the processor to: detect an identifier at each end of a cable and to store information of an installation location of the cable based on the detected identifiers.

In yet another exemplary embodiment, a server for supporting equipment service at a site includes a network interface communicatively coupled to a Head Mounted Equipment (HME) associated with an installer at a site; a data store storing data related to equipment including one or more of circuit packs, line modules, cables, and power equipment; a processor communicatively coupled to the network interface and the data store; and memory storing computer-executed instructions that, when executed, cause the processor to: receive, via the network interface, data relating to an inventory and location of the equipment at the site, wherein the data is collected by the HME during the equipment service, and check the equipment service based on the received data and at least one of plans associated with the site stored in the data store and configuration rules of the equipment stored in the data store. The memory storing computer-executed instructions that, when executed, can further cause the processor to provide information related to performing the equipment service to the HME via the network interface, during the equipment service, and receive from the HME, a detailed record of installation indicating information relating to at least one of deployed equipment, installed circuit packs, cable connectivity, operational status of the equipment based on LED indicators, and information gathered from the equipment.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various exemplary embodiments, systems and methods for equipment installation, configuration, maintenance, and personnel training are described. The systems and methods may use computer-enabled glasses with overlay display capability (e.g., Google Glass, or any other type of Head Up Display (HUD), HME, etc.) to provide visual and/or audible feedback to the user related to plug-in card information, acceptable equipment configuration, expected front-panel interconnection, flag possible configuration violations, provide operational status of equipment based on Light Emitting Diodes (LEDs), etc. Alternately, the systems and methods may utilize HME (e.g. Bluetooth headset) that is configured to provide information to the user solely by audible feedback. This approach is advantageous for installation, configuration and maintenance of equipment as well as for installer and engineer training and testing. The HME can also provide a traceable verification record of correct installation and certification, etc. The systems and methods provide unique benefits to both equipment manufacturers, network operators and equipment users including, for example, easier training, easier and faster installation, fewer installation errors, equipment configuration certification and traceability, feedback to design teams for improvements, etc. Also, the systems and methods keep information secure in digital format and may eliminate a need for detailed paper manuals which can find their way into competitor's hands and disclose valuable proprietary information. Further, the systems and methods enable on-going data collection during equipment service in a non-intrusive manner, i.e. without interfering with the installer's hands or requiring the installer to physically record data.

Figure 1:
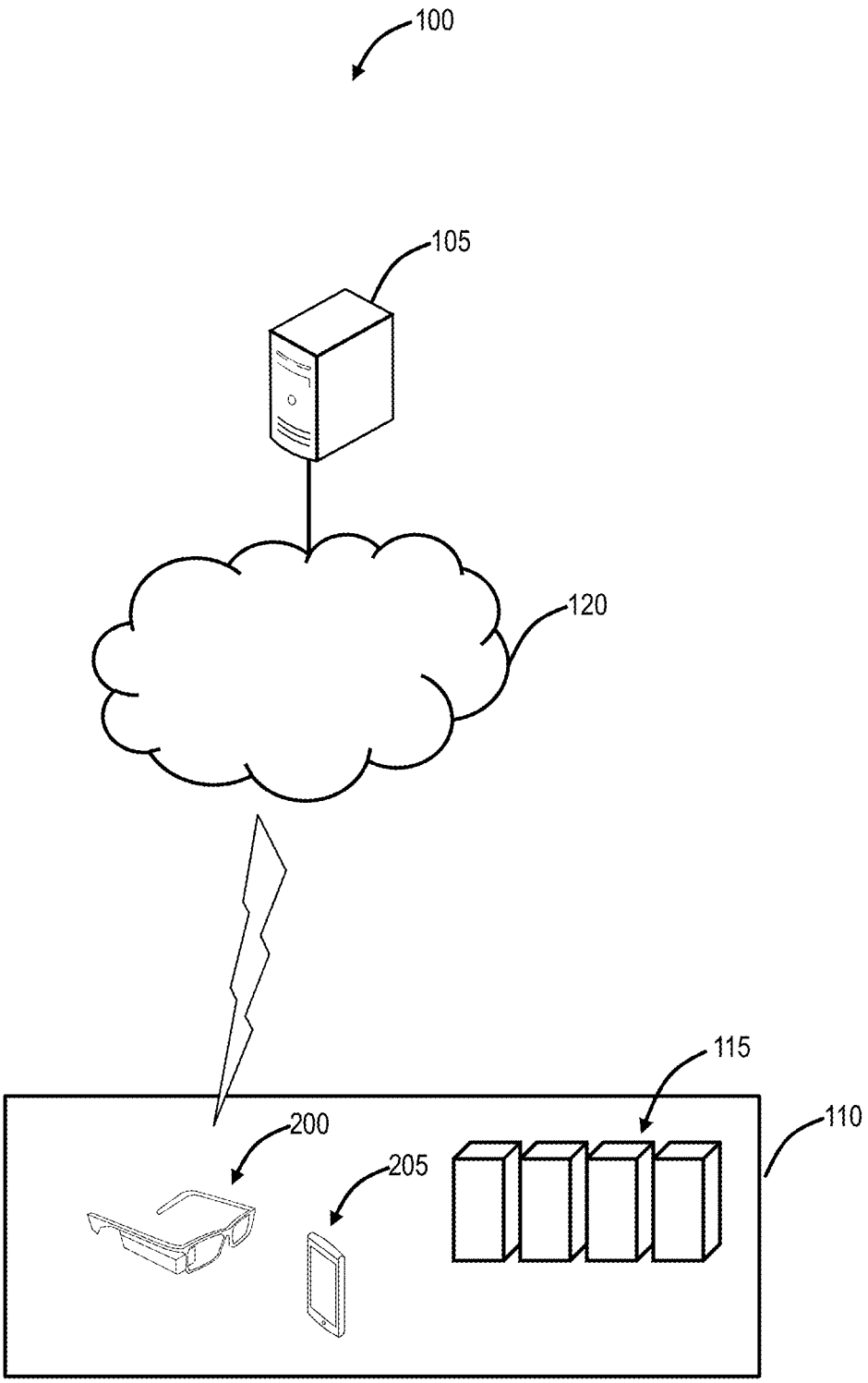
FIG. 1 is a network diagram of a system for equipment installation, configuration, maintenance, and personnel training.

Referring to FIG. 1, in an exemplary embodiment, a network diagram illustrates a system 100. The system 100 includes a server 105 and with equipment 115 being installed, maintained, provisioned, etc. at a site 110. The server 105 can communicate to devices at the site 110 via a network 120 such as the Internet, a Wide Area Network (WAN), a Virtual Local Area Network (VLAN), etc. The system 100 includes HME 200 which is associated with/utilized by an installer at the site 110 during equipment service on the equipment 115. Optionally, the installer has a mobile device 205 as well that can be communicatively coupled to the HME 200. The HME 200 can communicate wirelessly through the network 120 to the server 105, and optionally through the mobile device 205. The equipment 115 can include telecommunication, networking, high-performance computing, etc. equipment in various racks, chassis, etc. with shelves, rack units, etc. which include a plurality of pluggable modules, line cards, blades, power equipment, cabling, etc. The site 110 can be a Central Office (CO), Point-of-Presence (POP), Data Center, etc.

In an exemplary embodiment, the equipment 115 can include a network element that may consolidate the functionality of a multi-service provisioning platform (MSPP), digital cross connect (DCS), Ethernet and/or Optical Transport Network (OTN) switch, dense wave division multiplexed (DWDM) platform, etc. into a single, high-capacity intelligent switching system providing Layer 0, 1, and/or 2 consolidation. In another exemplary embodiment, the equipment 115 can be any of an OTN Add/Drop Multiplexer (ADM), a Multi-Service Provisioning Platform (MSPP), a Digital Cross-Connect (DCS), an optical cross-connect, an optical switch, a core or edge router, an Ethernet switch, a Wavelength Division Multiplexing (WDM) terminal, an access/aggregation device, a Storage Area Networking (SAN) device, a blade server, etc. That is, the equipment 115 includes complex, highly-configurable components that must be installed, provisioned, and maintained by the installer at the site 110.

The HME 200 has access to both computing power and information via wireless connectivity to the server 105 as well as locally, without network connectivity. Compute processing and information can come from the mobile device 205 such as a portable computer or tablet, or from the HME 200 itself. The HME 200 could also be accessed via connectivity to remote cloud processing and storage in the server 105. Accordingly, the HME 200 can be utilized to assist, monitor, and/or record the installation, provisioning, and maintenance of the equipment 115.

Figure 2A:
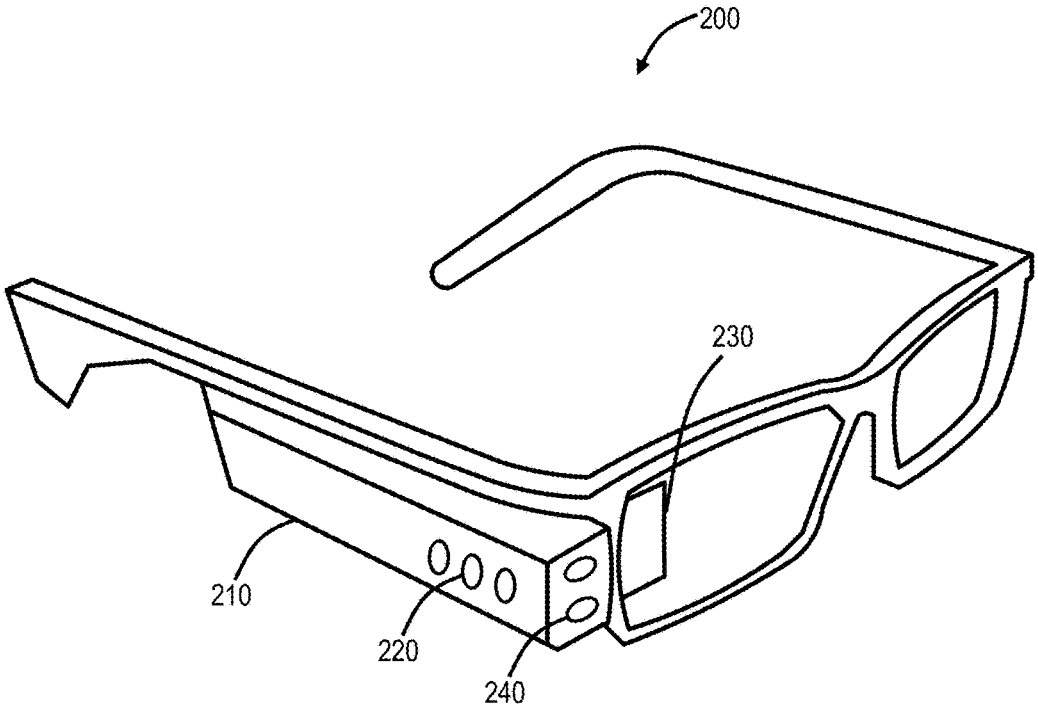
FIGS. 2A-2B are a perspective diagram (FIG. 2A) and a block diagram (FIG. 2B) of Head Mounted Equipment (HME)
Figure 2B:
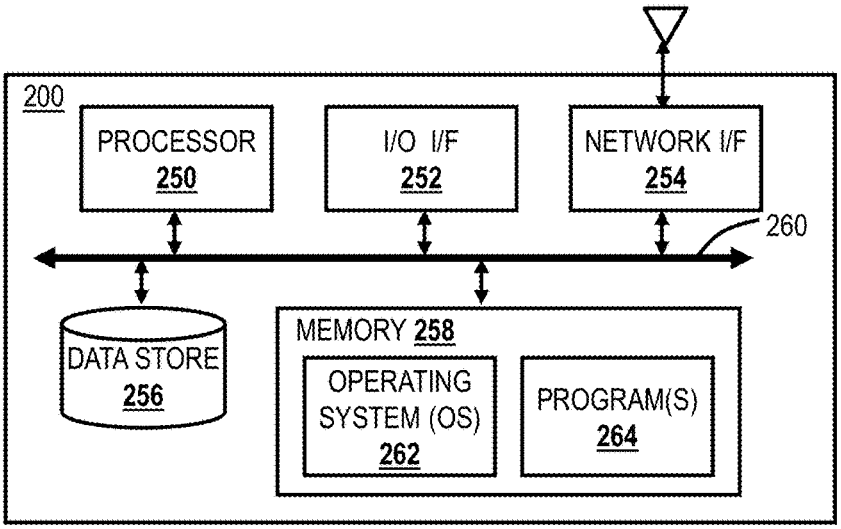

Referring to FIGS. 2A-2B, in an exemplary embodiment, a perspective diagram (FIG. 2A) and a block diagram (FIG. 2B) illustrate the HME 200. The HME 200 can be part of or attached to eyeglasses such that the HME 200 can be worn by the installer to provide visual and/or audible feedback while the installer's hands are free. That is, the HME 200 can include a form factor that is wearable by the installer or an installer over an eye or both eyes. The HME 200 can include a housing 210 for electronics, a battery, etc., i.e. the various functions described in FIG. 2B are stored in the housing 210. The housing 210 can include buttons 220 for various functions such as on/off, turn on/off audio commands, etc. The HME 200 can include optical components 230 that are coupled to the electronics for causing display to the installer's eyes, i.e. in the field of view. The housing 210 can also include a camera 240 for recording video and/or audio from the perspective of the installer.

In FIG. 2B, the HME 200, in terms of hardware architecture, generally includes a processor 250, input/output (I/O) interfaces 252, a network interface 254, a data store 256, and memory 258. It should be appreciated by those of ordinary skill in the art that FIG. 2B depicts the HME 200 in an oversimplified manner, and a practical embodiment can include additional components and suitably configured processing logic to support known or conventional operating features that are not described in detail herein. The components (250, 252, 254, 256, 258) are communicatively coupled via a local interface 260. The local interface 260 can be, for example but not limited to, one or more buses or other wired or wireless connections, as is known in the art. The HME 200 can also include a rechargeable battery, e.g. chargeable via a Universal Serial Bus (USB) connection.

The processor 250 is a hardware device for executing computer-executable instructions. The processor 250 can include a mobile optimized processor such as optimized for power consumption and mobile applications. When the HME 200 is in operation, the processor 250 is configured to execute computer-executable instructions stored within the memory 258, to communicate data to and from the memory 258, and to generally control operations of the HME 200 pursuant to the computer-executable instructions. The I/O interfaces 252 can be used to receive user input from and/or for providing system output. The I/O interfaces 252 are connected to the buttons 220, the optical components 230, the camera 240, a speaker, and a microphone. The HME 200 can be configured to operate via the buttons 220 and/or audible commands from the installer. Conceptually, many other modes of HME control are possible, for example: monitoring eye movement, monitoring head movement, detecting hand gestures in front of HME, etc.

The network interface 254 enables wireless communication to an external access device or network. The HME 200 can directly communicate on the network 120 and/or indirectly through a mobile device (e.g., a smart phone). The network interface 254 can include Bluetooth, Bluetooth Low Energy (BLE), IEEE 802.11 (any variation), Radio Frequency Identification (RFID), and/or Long Term Evolution (LTE). The data store 256 can include any of volatile memory elements (e.g., random access memory (RAM, such as DRAM, SRAM, SDRAM, and the like)), and combinations thereof. Moreover, the data store 256 can incorporate electronic, magnetic, optical, and/or other types of storage media. Note, the HME 200 can also include I/O interfaces such as a USB or mini-USB connection to provide power and/or data connectivity to a laptop, desktop, etc. Note, the systems and methods contemplate two modes of operation—one where the HME 200 operates collectively with the server 105 over a network connection and one where the HME 200 operates without network connectivity storing data locally in the data store 256. The locally stored data can be uploaded via the network interface 254 or through a wired connection such as USB.

The memory 258 can include any of volatile memory elements (e.g., random access memory (RAM, such as DRAM, SRAM, SDRAM, etc.)), and combinations thereof. The software in memory 258 can include one or more software programs, each of which includes an ordered listing of executable instructions for implementing logical functions. In the example of FIG. 2B, the software in the memory 258 includes a suitable operating system (O/S) 262 and programs 264. The operating system 262 essentially controls the execution of other computer programs, and provides scheduling, input-output control, file and data management, memory management, and communication control and related services. The operating system 262 can be any of LINUX (or another UNIX variant), Android (available from Google), Microsoft Windows 8.1, iOS (available from Apple, Inc.), and the like. The programs 264 can include various applications, add-ons, etc. configured to provide end user functionality with the HME 200. For example, exemplary programs 264 can include an installer assistance program as described herein.

In an exemplary embodiment, the HME 200 supports equipment service at the site 110, and the HME 200 includes a communication interface; a camera; a processor communicatively coupled to the communication interface and the camera; and memory storing computer-executed instructions that, when executed, cause the processor to: receive, via the communication interface, information related to performing an equipment service at a site, wherein the site comprises equipment comprising a plurality of circuit packs, line modules, cables, and power equipment; capture data relating to an inventory and location of the equipment at the site, wherein the data is collected by the HME during the equipment service; and check the equipment service based on the captured data based on at least one of plans associated with the site and configuration rules of the equipment.

The computer-executed instructions that, when executed, can further cause the processor to: cause display of visual cues related to the equipment, in a field of view of the installer. The computer-executed instructions that, when executed, can further cause the processor to: detect the equipment through the camera using one or more of recognizing one or more identifiers on the equipment and automatic image detection and processing algorithms to visually identify the equipment. The computer-executed instructions that, when executed, can further cause the processor to: recognize the equipment through wireless communication with the equipment, wherein the wireless communication utilizes any one or more of Bluetooth, Bluetooth Low Energy (BLE), and Radio Frequency Identification (RFID) technologies. The computer-executed instructions that, when executed, can further cause the processor to: detect an identifier at each end of a cable and to store information of an installation location of the cable based on the detected identifiers.

Figure 3:
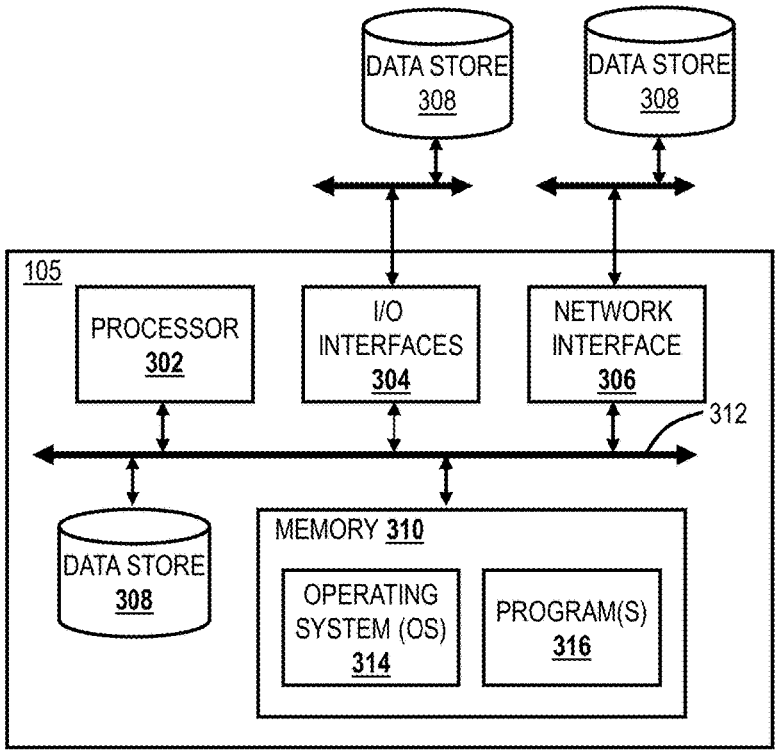
FIG. 3 is a block diagram of a server which can be used in the system of FIG. 1.

Referring to FIG. 3, in an exemplary embodiment, a block diagram illustrates a server 105 which can be used in the system 100 or standalone. The server 105 can be a digital computer that, in terms of hardware architecture, generally includes a processor 302, input/output (I/O) interfaces 304, a network interface 306, a data store 308, and memory 310. It should be appreciated by those of ordinary skill in the art that FIG. 3 depicts the server 105 in an oversimplified manner, and a practical embodiment may include additional components and suitably configured processing logic to support known or conventional operating features that are not described in detail herein. The components (302, 304, 306, 308, and 310) are communicatively coupled via a local interface 312. The local interface 312 can be, for example but not limited to, one or more buses or other wired or wireless connections, as is known in the art. The local interface 312 can have additional elements, which are omitted for simplicity, such as controllers, buffers (caches), drivers, repeaters, and receivers, among many others, to enable communications. Further, the local interface 312 can include address, control, and/or data connections to enable appropriate communications among the aforementioned components.

The processor 302 is a hardware device for executing software instructions. The processor 302 can be any custom made or commercially available processor, a central processing unit (CPU), an auxiliary processor among several processors associated with the server 105, a semiconductor-based microprocessor (in the form of a microchip or chip set), or generally any device for executing software instructions. When the server 105 is in operation, the processor 302 is configured to execute software stored within the memory 310, to communicate data to and from the memory 310, and to generally control operations of the server 105 pursuant to the software instructions. The I/O interfaces 304 can be used to receive user input from and/or for providing system output to one or more devices or components. User input can be provided via, for example, a keyboard, touch pad, and/or a mouse. System output can be provided via a display device and a printer (not shown). I/O interfaces 304 can include, for example, a serial port, a parallel port, a small computer system interface (SCSI), a serial ATA (SATA), a fibre channel, Infiniband, iSCSI, a PCI Express interface (PCI-x), an infrared (IR) interface, a radio frequency (RF) interface, and/or a universal serial bus (USB) interface.

The network interface 306 can be used to enable the server 105 to communicate on the network 120. The network interface 306 can include, for example, an Ethernet card or adapter (e.g., 10BaseT, Fast Ethernet, Gigabit Ethernet, 10 GbE) or a wireless local area network (WLAN) card or adapter (e.g., 802.11a/b/g/n). The network interface 306 can include address, control, and/or data connections to enable appropriate communications on the network. A data store 308 can be used to store data. The data store 308 can include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 308 can incorporate electronic, magnetic, optical, and/or other types of storage media. In one example, the data store 308 can be located internal to the server 105 such as, for example, an internal hard drive connected to the local interface 312 in the server 105. Additionally in another embodiment, the data store 308 can be located external to the server 105 such as, for example, an external hard drive connected to the I/O interfaces 304 (e.g., SCSI or USB connection). In a further embodiment, the data store 308 can be connected to the server 105 through a network, such as, for example, a network attached file server.

The memory 310 can include any of volatile memory elements (e.g., random access memory (RAM, such as DRAM, SRAM, SDRAM, etc.)), nonvolatile memory elements (e.g., ROM, hard drive, tape, CDROM, etc.), and combinations thereof. Moreover, the memory 310 can incorporate electronic, magnetic, optical, and/or other types of storage media. Note that the memory 310 can have a distributed architecture, where various components are situated remotely from one another, but can be accessed by the processor 302. The computer-executed instructions in memory 310 can include one or more software programs, each of which includes an ordered listing of executable instructions for implementing logical functions. The computer-executed instructions in the memory 310 includes a suitable operating system (O/S) 314 and one or more programs 316. The operating system 314 essentially controls the execution of other computer programs, such as the one or more programs 316, and provides scheduling, input-output control, file and data management, memory management, and communication control and related services. The one or more programs 316 may be configured to implement the various processes, algorithms, methods, techniques, etc. described herein.

The server 105 can include computer-executed instructions that, when executed, cause the processor to: provide information related to performing the equipment service to the HME via the network interface, during the equipment service; receive, via the network interface, data relating to an inventory and location of the equipment at the site, wherein the data is collected by the HME during the equipment service; and check the equipment service based on the received data and at least one of plans associated with the site stored in the data store and configuration rules of the equipment stored in the data store. The computer-executed instructions that, when executed, can further cause the processor to: receive from the HME, a detailed record of installation indicating information relating to at least one of deployed equipment, installed circuit packs, cable connectivity, operational status of the equipment based on LED indicators, and information gathered from the equipment.

Figure 4:
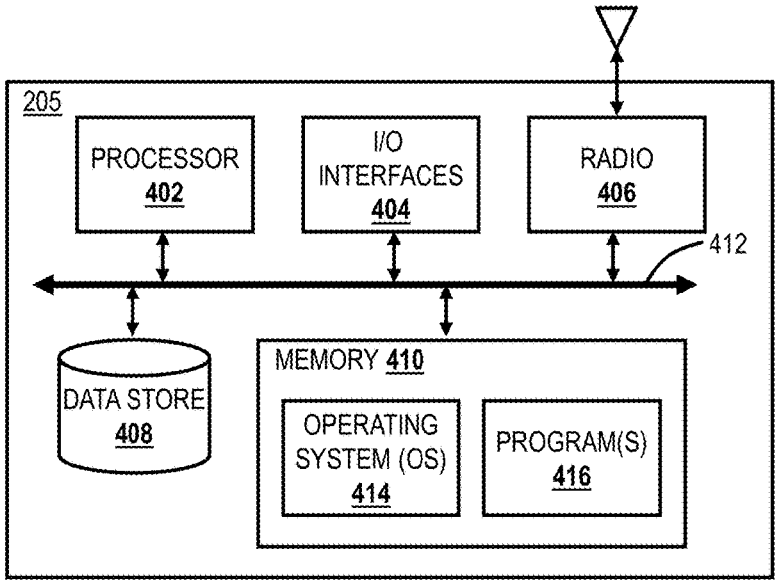
FIG. 4 is a block diagram of a mobile device which can be used in the system of FIG. 1.

Referring to FIG. 4, in an exemplary embodiment, a block diagram illustrates a mobile device 205, which can be used optionally in the system 100 or the like. The mobile device 205 can be a digital device that, in terms of hardware architecture, generally includes a processor 402, input/output (I/O) interfaces 404, a radio 406, a data store 408, and memory 410. It should be appreciated by those of ordinary skill in the art that FIG. 4 depicts the mobile device 205 in an oversimplified manner, and a practical embodiment can include additional components and suitably configured processing logic to support known or conventional operating features that are not described in detail herein. The components (402, 404, 406, 408, and 410) are communicatively coupled via a local interface 412. The local interface 412 can be, for example but not limited to, one or more buses or other wired or wireless connections, as is known in the art. The local interface 412 can have additional elements, which are omitted for simplicity, such as controllers, buffers (caches), drivers, repeaters, and receivers, among many others, to enable communications. Further, the local interface 412 may include address, control, and/or data connections to enable appropriate communications among the aforementioned components.

The processor 402 is a hardware device for executing software instructions. The processor 402 can be any custom made or commercially available processor, a central processing unit (CPU), an auxiliary processor among several processors associated with the mobile device 205, a semiconductor-based microprocessor (in the form of a microchip or chip set), or generally any device for executing software instructions. When the mobile device 205 is in operation, the processor 402 is configured to execute software stored within the memory 410, to communicate data to and from the memory 410, and to generally control operations of the mobile device 205 pursuant to the software instructions. In an exemplary embodiment, the processor 402 may include a mobile optimized processor such as optimized for power consumption and mobile applications. The I/O interfaces 404 can be used to receive user input from and/or for providing system output. User input can be provided via, for example, a keypad, a touch screen, a scroll ball, a scroll bar, buttons, bar code scanner, and the like. System output can be provided via a display device such as a liquid crystal display (LCD), touch screen, and the like. The I/O interfaces 404 can also include, for example, a serial port, a parallel port,), an infrared (IR) interface, a radio frequency (RF) interface, a mini universal serial bus (USB) interface, and the like. The I/O interfaces 404 can include a graphical user interface (GUI) that enables a user to interact with the mobile device 205. Additionally, the I/O interfaces 404 may further include an imaging device, i.e. camera, video camera, etc.

The radio 406 enables wireless communication to an external access device or network. Any number of suitable wireless data communication protocols, techniques, or methodologies can be supported by the radio 406, including, without limitation: RF; IrDA (infrared); Bluetooth; ZigBee (and other variants of the IEEE 802.15 protocol); IEEE 802.11 (any variation); IEEE 802.16 (WiMAX or any other variation); Long Term Evolution (LTE); cellular/wireless/cordless telecommunication protocols (e.g. 3G/4G, etc.); and any other protocols for wireless communication. The radio 406 can include multiple types of wireless connectivity, e.g. Bluetooth/IEEE 802.11 for communication with the HME 200 and LTE for communication with the network 120. The data store 408 can be used to store data. The data store 408 can include any of volatile memory elements (e.g., random access memory (RAM, such as DRAM, SRAM, SDRAM, and the like)), and combinations thereof.

The memory 410 can include any of volatile memory elements (e.g., random access memory (RAM, such as DRAM, SRAM, SDRAM, etc.)), nonvolatile memory elements (e.g., ROM, hard drive, etc.), and combinations thereof. Moreover, the memory 410 may incorporate electronic, magnetic, optical, and/or other types of storage media. Note that the memory 410 can have a distributed architecture, where various components are situated remotely from one another, but can be accessed by the processor 402. The software in memory 410 can include one or more software programs, each of which includes an ordered listing of executable instructions for implementing logical functions. In the example of FIG. 4, the software in the memory 410 includes a suitable operating system (O/S) 414 and programs 416. The operating system 414 essentially controls the execution of other computer programs, and provides scheduling, input-output control, file and data management, memory management, and communication control and related services. The programs 416 can include various applications, add-ons, etc. configured to provide end user functionality with the mobile device 205. For example, exemplary programs 416 can include, but not limited to, a web browser, social networking applications, streaming media applications, games, mapping and location applications, electronic mail applications, financial applications, and the like.

Figure 5:
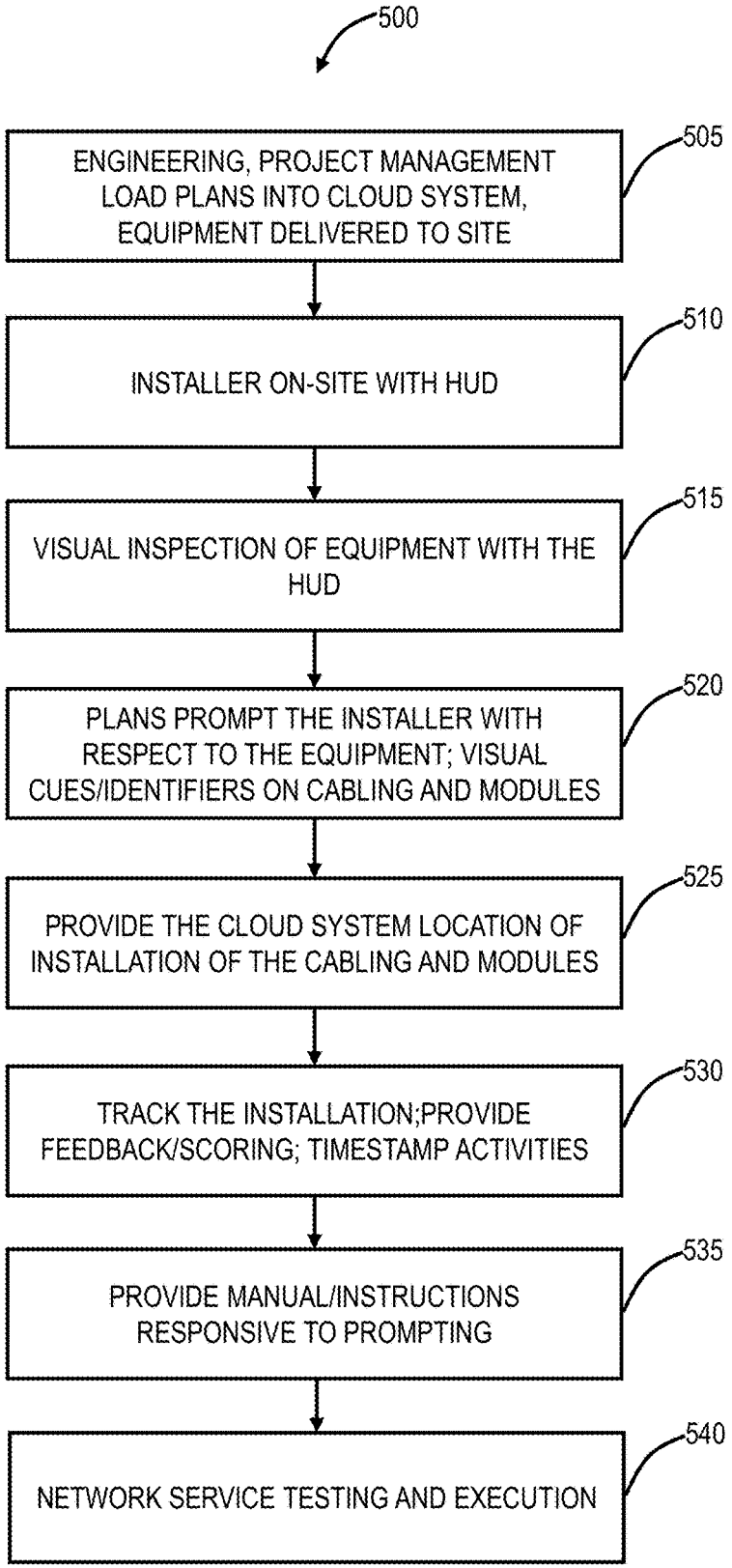
FIG. 5 is a flowchart of a method for equipment installation, configuration, maintenance, and personnel training which can be used in the system of FIG. 1.

Referring to FIG. 5, in an exemplary embodiment, a flowchart illustrates a method 500. The method 500 contemplates operation in the system 100 for equipment service including installing, provisioning, and/or maintaining the equipment 115. The method 500 includes an engineering and project management phase where engineering plans are developed and loaded into the server 105 and the equipment 115 is delivered to a site (step 505). Here, the configuration and installation requirements are developed for how the equipment 115 should be installed and provisioned. This can include circuit pack assignments in a chassis, cabling assignments, etc. The engineering and project management phase can also include manufacturing and delivery of the equipment 115. That is, the engineering and project management phase includes all activity prior to the equipment 115 and the installer with the HME 200 arriving at the site 110.

Once the installer arrives at the site 110 with the HME 200 (step 510), the installer can take a visual inspection of the equipment 115 with the HME (step 515). During the visual inspection, the camera of the HME captures data that can be used to inventory the equipment 115 at the site 110. The visual inspection of the equipment 115 can thus serve to establish a reference point for the specific configuration. For example, the HME 200 can perform appropriate image processing algorithms during the visual inspection to capture information about the equipment 115. The image processing algorithms can identify different pieces of the equipment 115.

The equipment 115 can be recognized by the HME 200 with the camera 240 using any one or more of the following techniques: i) general features using image recognition; ii) particular specialized labeling of modules with an identifier such as a Bar Code, Quick Response (QR) Code, serial number, etc.; iii) wireless communication with the equipment 115 such as via iBeacon, Bluetooth, Bluetooth Low Energy (BLE), Radio Frequency Identification (RFID) etc.; and the like.

A QR code is a two dimensional matrix barcode typically having information encoded in the placement of black square matrix elements (dots) on a white background. A QR code, for example, might be permanently or temporarily applied to a card as a sticker or other graphical medium.

The HME 200 and/or the mobile device 205 can include Global Positioning Satellite (GPS) or any other location service that can be used to automatically associate the equipment 115 with the site 110. Configuration information can be obtained from: i) embedded equipment software; ii) software on a local external computer, tablet, server, etc.; and/or iii) wirelessly loaded from cloud storage on the server 105. Thus, the HME 200 can be loaded with instructions to assist the installer at the site. In addition, the HME 200 can utilize the engineering plans, etc. to prompt the installer with respect to the equipment 115 and the HME 200 can use visual cues and/or identifiers on the cabling and modules to identify and show location of the cabling and modules (step 520)

The HME 200 uses the identifiers, e.g. QR code, Bar Code, etc., detected by the camera 240. That is, the HME 200 identifies the equipment 115 in the field of view. The HME 200 can provide visual cues overlaid, in the field of view of the HME 200, onto the equipment 115 as the installer looks at it can be provided during the installation process. These can show which circuit packs can be plugged into which available slots, and once installed, proper installation can be certified by further image processing, detecting an operational state of the equipment 115 such as through LED information, and/or communicating with equipment software.

Cabling information can also be overlaid onto the equipment to show proper optical and electrical interconnection. Depending on cable density and cable trays, it may not always be possible to visually trace each cable from one point to the other. In this case, both ends of each cable can be labeled with the same code, but distinct from other cables at the same installation site. Visual association of cable codes at both ends to the equipment circuit packs provides connection validation. Once the equipment 115, e.g. circuit packs, modules, etc., is installed, the HME 200 can provide the server 105 the location of installation of the cabling and modules (step 525).

The HME 200 can keep a detailed record of installation, deployed equipment, installed circuit packs, cable connectivity, operational status of the equipment 115 based on LED indicators, and information gathered from equipment and remote servers can be stored for record keeping, certification purposes, etc. The HME 200 can track the installation; provide feedback/scoring; and time stamp activities (step 530).

Time stamps can be associated with various activities, and subsequent analysis may be performed to see if any specific steps have been proving particularly time consuming, troublesome, or otherwise causing an unexpected operating expense impact (either positive or negative). This information can be relayed to equipment suppliers for design or process improvement. As an alternative to providing visual cues for installation, these may be omitted during installer or engineer training and testing phase. But captured data and checking can provide either immediate feedback, or delayed scoring, on installation accuracy and installer performance.

In an installer training mode, information provided to the installer, through the HME 200, is either limited or eliminated. The HME 200 can monitor the installation (optionally with the server 105), but can limit feedback. The feedback could be provided at the end of the install process, either as a score, or with specific identifiers or pictures of what was done incorrectly, and how it should be fixed. Feedback could also be provided in shorter stages during the overall install process. Some final score or certification can be assigned to the installer.

The HME 200, through the server 105, can also provide manuals and instructions to the installer responsive to prompting (step 535). Again, this alleviates the need for written manuals which tend to find their way into competitor's hands. Also, the manuals can be displayed on the mobile device 205 and/or through the HME 200.

The HME 200 can also be utilized for network service testing initiation and execution (step 540). As a final step, after completing equipment installation, the installer could communicate to the server 105, through a menu item on the HME 200 or the mobile device 205 perhaps, to initiate a network self-test of the equipment 115 that has just completed installation if that capability is supported. Alternatively, if separate test equipment must be connected to the equipment 115 just installed, the process flow could include this while the installer is on site so that any local issues could be addressed. The HME 200 could prompt this test setup, with aid to setting up the test configuration.

Figure 6:
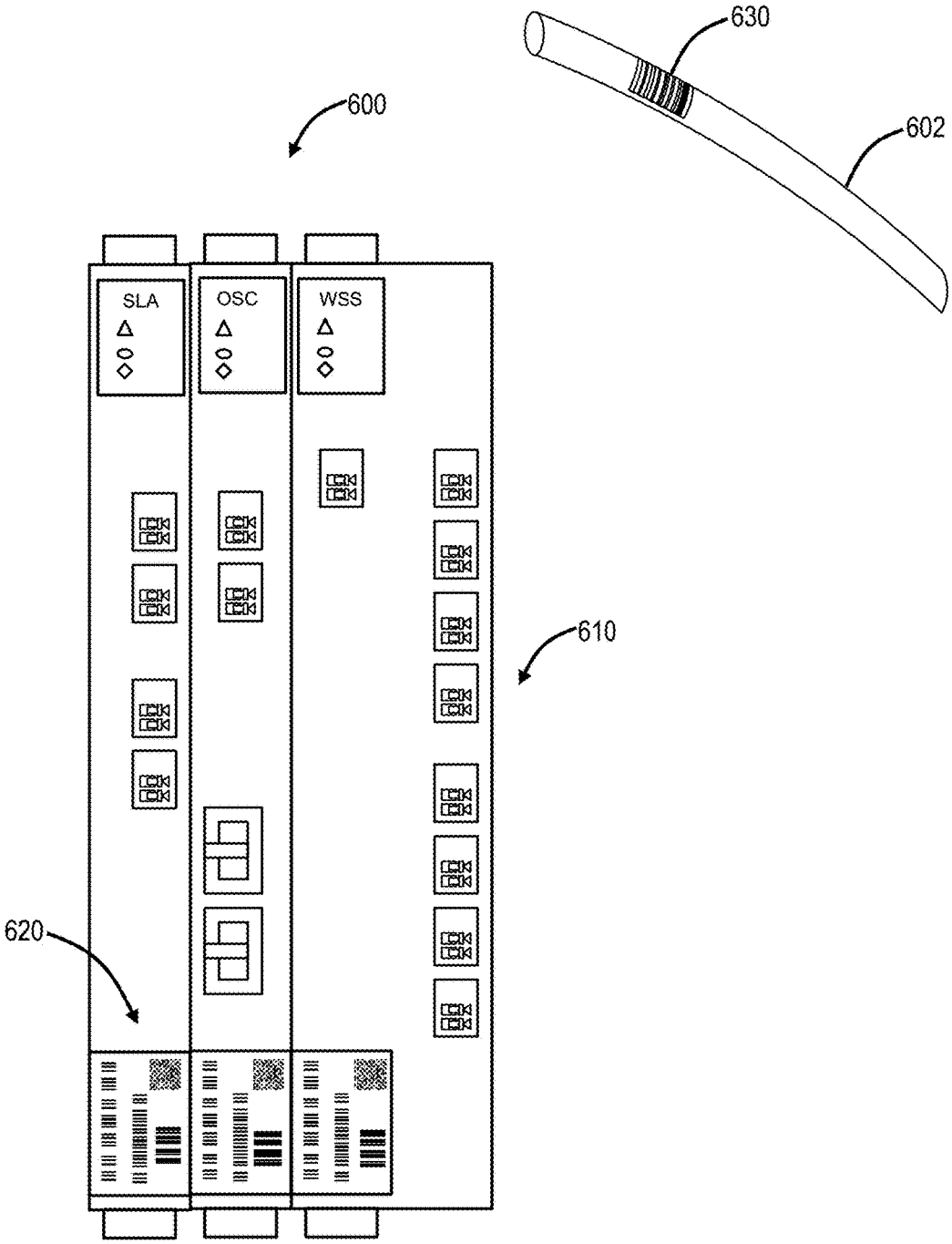
FIG. 6 is a perspective diagram of circuit packs and a cable for use in the system of FIG. 1.

Referring to FIG. 6, in an exemplary embodiment, a perspective diagram illustrates circuit packs 600 and a cable 602 for use in the system 100. For example, the circuit packs 600 can include an amplifier (SLA), Optical Service Channel (OSC), or a Wavelength Selective Switch (WSS); of course, any type of circuit pack is contemplated herewith. The circuit packs 600 include a plurality of connections 610 which can be optical or electrical. For the system 100, the circuit packs 600 include identifiers 620 such as bar codes, QR codes, serial numbers, etc. which can be used by the HME 200 to uniquely identify the circuit packs 600.

The cable 602 can be electrical or optical and it also includes an identifier 630 such as bar codes, QR codes, serial numbers, etc. The identifier 630 can be at both ends of the cable 602 so that the HME 200 can identify both endpoints of the cable 602 in the installation.

Figure 7:
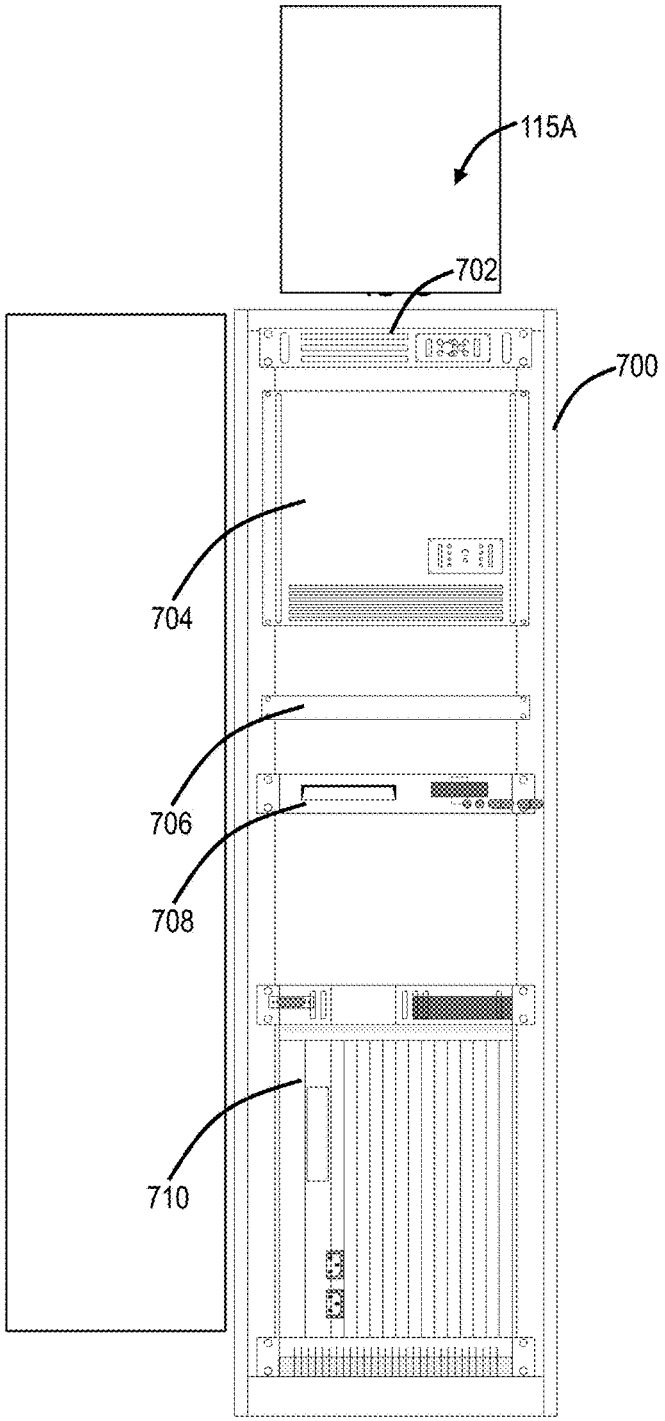
FIG. 7 is a front view of a chassis and associated shelves and equipment for use in the system of FIG. 1.

Referring to FIG. 7, in an exemplary embodiment, a front view illustrates exemplary equipment 115A including a rack 700, a power supply 702, a shelf 704, a patch panel 706, a server 708, and a switch 710. The equipment 115A is illustrated as an example for use with the HME 200. An installer has to cable the power supply 702 to an appropriate power supply as well as power cabling to the shelf 704, the server 708, and the switch 710. The shelf 704 can be any type of network element and can include various cables to the patch panel 706 or the like. The switch 710 can also include various circuit packs, such as the circuit packs 600 which are selectively inserted and cabled to the patch panel 706 or the like.

It will be appreciated that some exemplary embodiments described herein may include one or more generic or specialized processors ("one or more processors") such as microprocessors, digital signal processors, customized processors, and field programmable gate arrays (FPGAs) and unique stored program instructions (including both software and firmware) that control the one or more processors to implement, in conjunction with certain non-processor circuits, some, most, or all of the functions of the methods and/or systems described herein. Alternatively, some or all functions may be implemented by a state machine that has no stored program instructions, or in one or more application specific integrated circuits (ASICs), in which each function or some combinations of certain of the functions are implemented as custom logic. Of course, a combination of the aforementioned approaches may be used. Moreover, some exemplary embodiments may be implemented as a non-transitory computer-readable storage medium having computer readable code stored thereon for programming a computer, server, appliance, device, etc. each of which may include a processor to perform methods as described and claimed herein. Examples of such computer-readable storage mediums include, but are not limited to, a hard disk, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory), Flash memory, and the like. When stored in the non-transitory computer readable medium, software can include instructions executable by a processor that, in response to such execution, cause a processor or any other circuitry to perform a set of operations, steps, methods, processes, algorithms, etc.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A method, performed by a server, for supporting equipment service at a site, the method comprising:

receiving, from Head Mounted Equipment (HME) associated with an installer at a site, data relating to an inventory and location of equipment at the site, wherein the data is collected by the HME during equipment service, wherein the equipment comprises one or more circuit packs, line modules, cables, and power equipment;

checking the equipment service based on the received data and at least one of plans associated with the site and configuration rules of the equipment; and subsequent to installing the cable, detecting an identifier at each end of the cable to provide information related to which of the one or more circuit packs, line modules, and power equipment are cabled to one another, wherein the identifier is detected in a field of view of the HME and correlated to another identifier associated with the one or more circuit packs, line modules, and power equipment and such correlation is stored by the server for record keeping and certification of the equipment service.

2. The method of claim 1, further comprising providing information related to performing the equipment service to the HME, during the equipment service, wherein the HME is configured to display visual cues related to the equipment, in a field of view of the installer.

3. The method of claim 2, wherein the visual cues show the installer which slots the equipment can be installed in and, once installed, the HME is configured to detect if the equipment was properly installed based on image processing, based on operational state of the equipment based on LED indicators, and/or communicating with equipment software.

4. The method of claim 1, wherein the HME is configured to detect the equipment through a camera, wherein the camera is configured to perform one of recognizing one or more identifiers on the equipment and automatic image detection and processing algorithms to visually identify the equipment.

5. The method of claim 4, wherein the one or more identifiers comprise at least one of a Bar Code, Quick Response (QR) Code, and a serial number.

6. The method of claim 1, wherein the HME is configured to recognize the equipment through wireless communication between the HME and the equipment, wherein the wireless communication utilizes any one or more of Bluetooth, Bluetooth Low Energy (BLE), and Radio Frequency Identification (RFID) technologies.

7. The method of claim 1, wherein the location of the equipment is based on determining the site using location services associated with the HME and on determining a particular location at the site based on correlation of visual identification of identifiers on the equipment.

8. The method of claim 1, wherein the information related to the equipment service is responsive to engineering associated with the site.

9. The method of claim 1, further comprising:

receiving from the HME, a detailed record of installation indicating information relating to at least one of deployed equipment, installed circuit packs, cable connectivity, operational status of the equipment based on LED indicators, and information gathered from the equipment.

10. The method of claim 1, wherein the HME communicates to the server through a mobile device.

11. The method of claim 1, further comprising:

providing manuals related to the equipment to the HME.

12. The method of claim 1, wherein the equipment service is a service relating to at least one of installation, configuration and maintenance of the equipment.

13. Head Mounted Equipment (HME) for supporting equipment service by an installer at a site, the HME comprising:

a communication interface;

a camera;

a processor communicatively coupled to the communication interface and the camera; and memory storing computer-executed instructions that, when executed, cause the processor to capture data relating to an inventory and location of equipment at the site, wherein the data is collected by the HME during the equipment service, and wherein the equipment comprises one or more circuit packs, line modules, cables, and power equipment, check the equipment service based on the captured data based on at least one of plans associated with the site and configuration rules of the equipment; and subsequent to installing the one or more cables, detecting an identifier at each end of the one or more cables to provide information related to which of the one or more circuit packs, line modules, and power equipment are cabled to one another, wherein the identifier is detected in a field of view of the HME and correlated to another identifier associated with the one or more circuit packs, line modules, and power equipment and such correlation is stored by a server for record keeping and certification of the equipment service.

14. The HME of claim 13, wherein the memory storing computer-executed instructions that, when executed, further cause the processor to:

receive, via the communication interface, information related to performing the equipment service at the site, and cause display of visual cues related to the equipment, in a field of view of the installer.

15. The HME of claim 13, wherein the memory storing computer-executed instructions that, when executed, further cause the processor to:

detect the equipment through the camera using one or more of recognizing one or more identifiers on the equipment and automatic image detection and processing algorithms to visually identify the equipment.

16. The HME of claim 13, wherein the memory storing computer-executed instructions that, when executed, further cause the processor to:

recognize the equipment through wireless communication with the equipment, wherein the wireless communication utilizes any one or more of Bluetooth, Bluetooth Low Energy (BLE), and Radio Frequency Identification (RFID) technologies.

17. A server for supporting equipment service at a site, the server comprising:

a network interface communicatively coupled to a Head Mounted Equipment (HME) associated with an installer at a site;

a data store storing data related to equipment comprising one or more circuit packs, line modules, cables, and power equipment;

a processor communicatively coupled to the network interface and the data store; and memory storing computer-executed instructions that, when executed, cause the processor to receive, via the network interface, data relating to an inventory and location of the equipment at the site, wherein the data is collected by the HME during the equipment service, check the equipment service based on the received data and at least one of plans associated with the site stored in the data store and configuration rules of the equipment stored in the data store; and subsequent to installing the one or more cables, detecting an identifier at each end of the one or more cables to provide information related to which of the one or more circuit packs, line modules, and power equipment are cabled to one another, wherein the identifier is detected in a field of view of the HME and correlated to another identifier associated with the one or more circuit packs, line modules, and power equipment and such correlation is stored by the server for record keeping and certification of the equipment service.

18. The server of claim 17, wherein the memory storing computer-executed instructions that, when executed, further cause the processor to:

provide information related to performing the equipment service to the HME via the network interface, during the equipment service, and receive from the HME, a detailed record of installation indicating information relating to at least one of deployed equipment, installed circuit packs, cable connectivity, operational status of the equipment based on LED indicators, and information gathered from the equipment.

* * * * *